US006308872B1

(12) United States Patent
Duerr et al.

(10) Patent No.: US 6,308,872 B1
(45) Date of Patent: Oct. 30, 2001

(54) HANGER WITH MULTIPLE MEANS FOR SUPPORTING OTHER HANGERS

(75) Inventors: Oliver K. Duerr, Springfield; Jens K. Duerr, Pittstown; Karl Duerr, Basking Ridge, all of NJ (US)

(73) Assignee: Acotex-Duerr Inc, New York, NY (US)

( * ) Notice: Subject to any disclaimer, the term of this patent is extended or adjusted under 35 U.S.C. 154(b) by 0 days.

(21) Appl. No.: 09/668,278

(22) Filed: Sep. 25, 2000

(51) Int. Cl.[7] ..... A47G 25/18; A47G 25/14
(52) U.S. Cl. ..... 223/88; 223/85
(58) Field of Search ..... 223/85, 88, 92, 223/DIG. 4, 95, 96

(56) References Cited

U.S. PATENT DOCUMENTS

| | | | | |
|---|---|---|---|---|
| D. 275,539 | | 9/1984 | Mainetti . | |
| 4,653,678 | | 3/1987 | Blanchard . | |
| 4,730,737 | | 3/1988 | Robinson . | |
| 4,871,098 | * | 10/1989 | Bredeweg et al. | 223/85 |
| 5,074,445 | * | 12/1991 | Chen | 223/85 |
| 5,074,446 | | 12/1991 | Suddath . | |
| 5,803,321 | | 9/1998 | Willinger . | |
| 5,894,969 | | 4/1999 | Speckert . | |
| 5,934,525 | | 8/1999 | Blanchard . | |
| 6,070,772 | * | 6/2000 | Bond | 223/85 |

* cited by examiner

*Primary Examiner*—Bibhu Mohanty
(74) *Attorney, Agent, or Firm*—Lilling & Lilling P.C.

(57) ABSTRACT

The disclosed hanger includes two means for supporting hangers. There is an opening in the top panel which permits entry of a hook from another hanger from front to back. A downwardly depending ganging member includes offset front and rear walls. The front and rear walls are spaced, so as to define a second passage to permit the entry of a hook from side to side. Inner edges of the front and rear walls are spaced sufficiently close, so as to prevent the passage of the hook of another hanger from front to back.

9 Claims, 2 Drawing Sheets

HANGER WITH MULTIPLE MEANS FOR SUPPORTING OTHER HANGERS

FIELD OF THE INVENTION

This invention relates to the clothing industry and, in particular, to an improved hanger which provides multiple means for supporting other hangers.

BACKGROUND OF THE INVENTION

For many years, various types of hangers in different shapes and sizes have been used to support all different types of clothing, including coats, jackets, shirts, pants and other articles of clothing. In many instances, it is useful to suspend one hanger from another hanger. This may be useful in order to display together clothes from a matched set, or perhaps simply to reduce the amount of space required for displaying or storing clothing.

Retail practices today frequently require that many products be displayed on hangers in the retail selling area. This necessarily requires an esthetically pleasing hanger on which the garment is hung prior to placing it on the retail selling floor.

During the manufacturing process, it is usual for garments to be manufactured and shipped on hangers. Such hangers are usually inexpensive hangers, which are not esthetically pleasing. When the garments with these hangers reach the retailer, it is necessary for the retailer to remove the hanger on which the garment was shipped and replace it with a more esthetically pleasing hanger for the use on the selling floor. This necessarily causes millions of hangers to be removed and discarded each year by retailers. Not only does this require a great deal of labor, but it is also very wasteful, when considering the number of hangers that are discarded.

Hangers that have some type of ganging device for supporting other hangers are known in the industry. For example, Willinger (U.S. Pat. No. 5,803,321) discloses a hanger with a hook receiving element that has intersecting passage ways for selectively receiving the hook from another hanger. One of the problems of this design is that the size of the passageways is necessarily limited and only hooks of a certain size may be used. Further, because the passageways intersect, while the hanger will permit a hook to enter from either front to back or from side to side, the ganging device cannot be utilized to support more than one other hanger at the same time. This is because the passageways intersect and necessarily prevent hooks from two different directions.

A hanger with another type of ganging member is disclosed by Blanchard (U.S. Pat. No. 4,653,678). In this device, the ganging member has a J-shaped structure, but hooks from other hangers may enter only from side to side, and not from front to back. Further, as there is only one passageway, only one other hanger may be supported at a time.

Therefore, there is a need in the industry for a hanger of a simple construction that allows hooks from other hangers to enter either from side to side or from front to back and which will also permit more than one other hanger to be suspended at the same time.

Another important need in the industry is for one simple esthetically pleasing hanger that can be used for shipments of garments and then used by the retailer for displaying the same garment.

SUMMARY OF THE INVENTION

Therefore, it is an object of the invention to provide a hanger that has means to permit a hook from another hanger to enter from either side to side or from front to back.

These and other objects of the invention can be achieved with a hanger of basic design which has a downwardly depending ganging member. The ganging member has front and rear walls which are offset and are spaced from each other, so as to define a passageway between them. This passageway permits a hook from another hanger to enter from side to side and to be suspended by the ganging member. Inner edges of the front and rear walls are basically aligned, so that there is no passageway defined from front to back that would permit the passage of a hook.

In an upper panel of the hanger, an opening is provided, which permits the passage of a hook of another hanger from front to back (or from back to front). The combination of the ganging member and the opening in the upper member provide two passageways in the hanger for supporting other hangers. Due to the orientation and positioning of the ganging member and the opening, it is possible, if the hook from another hanger is sufficiently long, for more than one hanger to be held at the same time.

This new design is also esthetically pleasing and provides a modem look to the hanger. Use of the hanger of this invention substantially reduces the waste of the hangers that are currently being used by manufactures for shipping garments. There is also a reduction in the order-to-sales-floor cycle time. Labor costs are maintained, as it is no longer necessary to change the garment from the shipping hanger to the display hanger.

DETAILED DESCRIPTION OF THE INVENTION

Figures 1, 3:
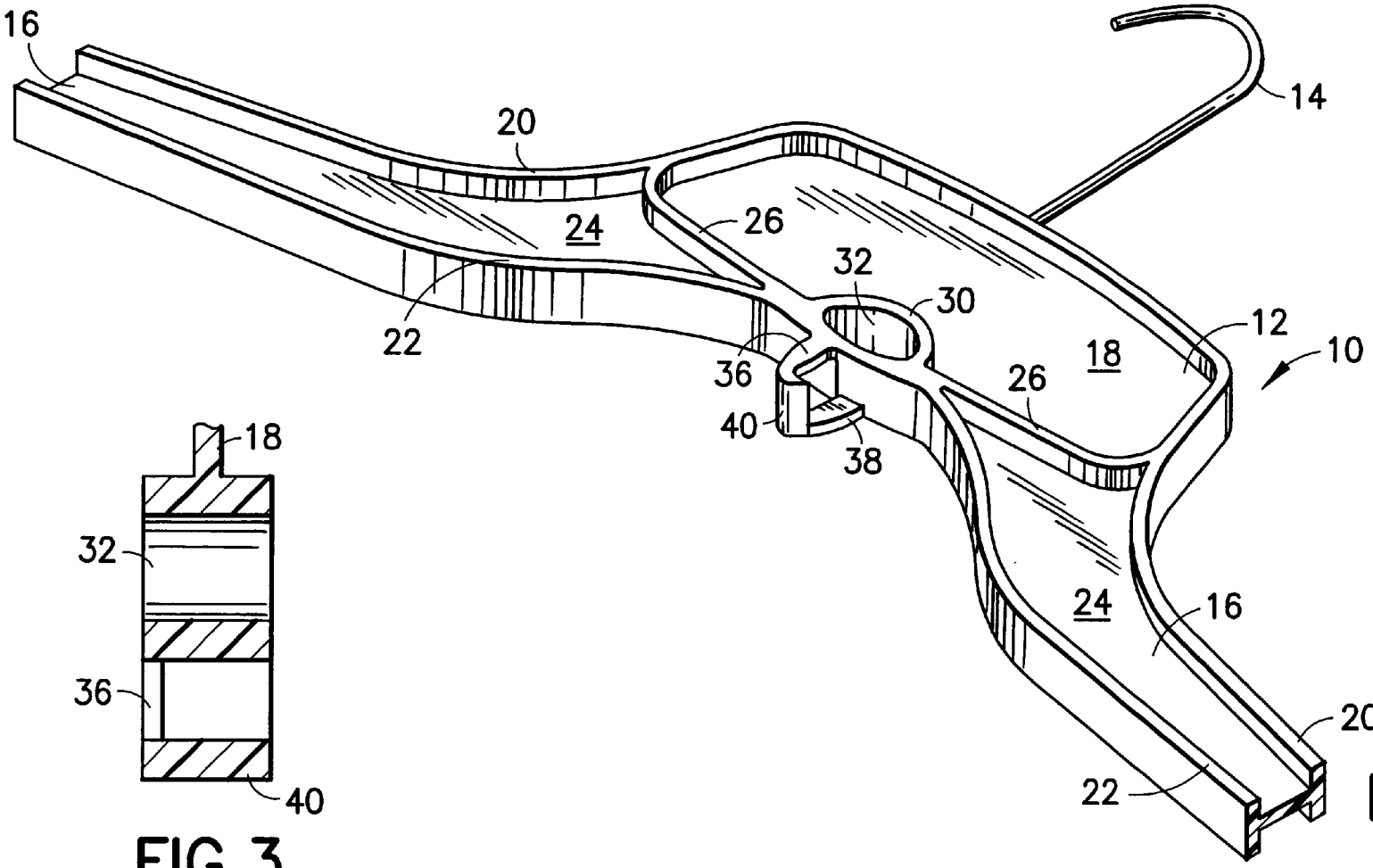
FIG. 1 is a perspective view showing the new hanger of this invention.
FIG. 3 is a cross-sectional view taken along the lines 3—3 of FIG. 2.
Figure 2:
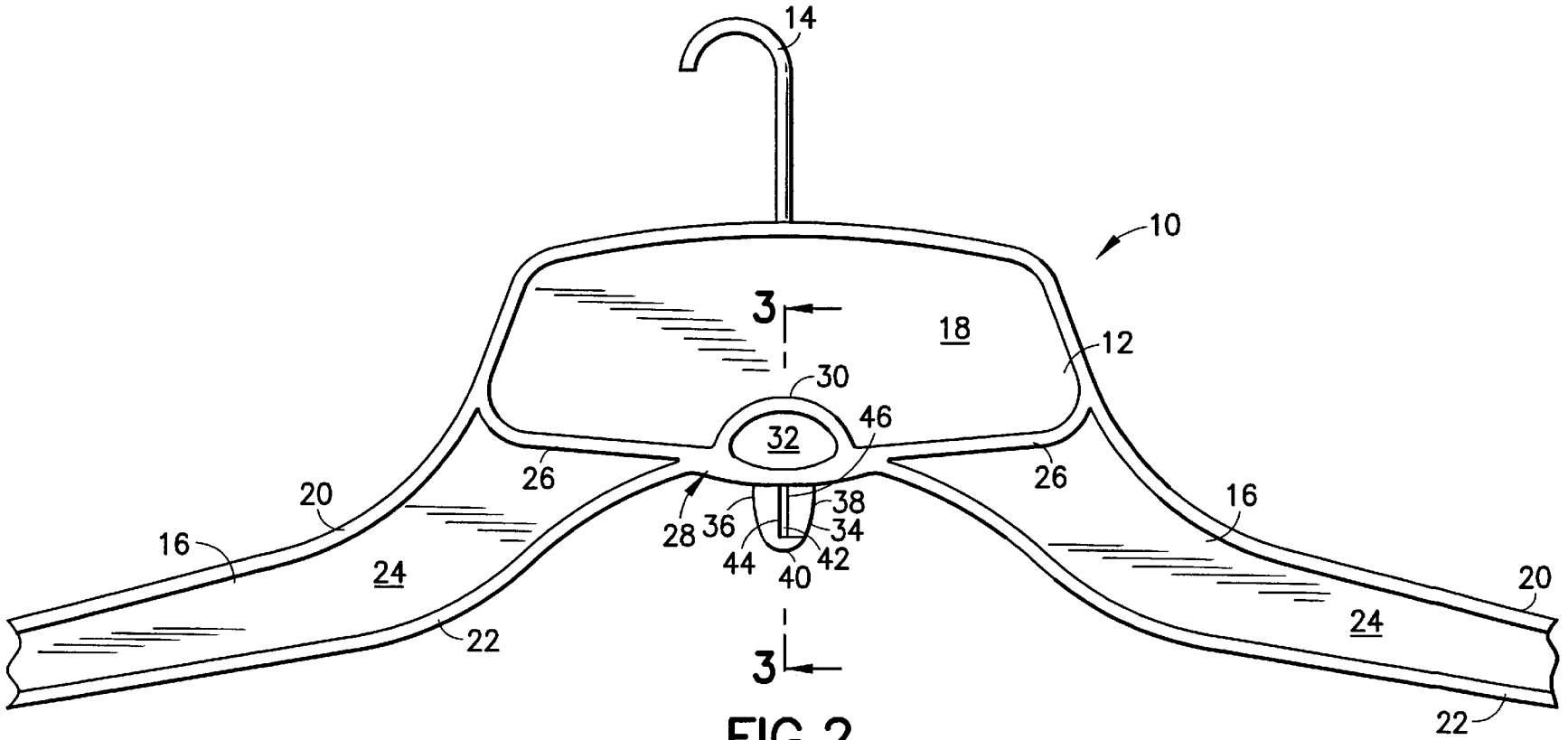
FIG. 2 is a front view of the ganging member and the upper panel of the hanger.

The basic hanger 10 can be of any size, shape and configuration that is standard in the industry. In the preferred embodiment, the hanger is a one piece, integral molded unit made of a reasonably strong, semi-rigid plastic, such as styrene-butadiene. Such plastics are manufactured by Phillips 66 under the Trademark K-RESIN and by BASF under the trademark SYROLUX. Any other materials that are accepted in the industry for making plastic hangers may be used.

The basic hanger 10 includes a one piece, molded body 12. As is conventional, there are downwardly sloping arms 16 of any standard shape and size. At the top of the unit, there is a rotatably mounted hook 14, as is customary in hangers.

As is known in the industry, the hook may be made of any suitable wire stock or other metal. In a preferred embodiment, the hanger has an I-beam type construction. The arms have upper and lower flanges 20 and 22, which are joined by a vertical web 24. These pieces are all molded together, in known fashion, to create the unitary hanger. The upper flange 20 continues along the top portion of the two arms and extends along the top surface of the hanger, so as to create a continuous flange from the outer tip of one arm through to the outer tip of the other arm. In like fashion, the lower flange 22 extends along the bottom of the hanger in continuous fashion.

A middle flange 26 joins with the upper flange 20 at the approximate point where the upper flange 20 bends upward to circumscribe the upper portion of the hanger. The middle flange then extends towards the middle of the hanger and joins with the lower flanges 22 from the two arms to define a central support shoulder 28. Within the support shoulder 28, there is a curved flange 30 which connects the two middle flanges 26 and, together with the lower flanges 22, defines an opening 32 in the lower portion of the top panel 18.

The opening 32 may be of any appropriate size and configuration. It must, however, be of a sufficient size so as to be large enough to accept the passage of a hook from another hanger. In the preferred embodiment, the opening has an oval shape for cosmetic reasons, but it can be made circular, triangular, square or any other pleasing shape. The important characteristic is that it must be of a sufficient size to receive the hook of another hanger.

Depending downward from the shoulder 28 is a ganging member 34. It too is made integral with the hanger, as is known in the industry. The ganging member includes front and rear walls 36 and 38, connected by a bottom base 42. The particular shape and size of the walls will be dependent on the esthetic considerations of the hanger. In some configurations, it may be desirable to have a curved sloping design for the walls, so as to make the hanger look more futuristic and modem.

The front and rear walls 36 and 38 are spaced sufficiently apart, so as to define a lateral passageway. The passageway must be of sufficient dimension, so that the hook of another hanger may pass from side to side. Then, the top curved portion of the hook would rest on the base of the ganging member in order to be supported.

In the preferred embodiment, the front and rear walls 36 and 38 are offset in a horizontal plane, so that their inner edges 44 and 46 are approximately in alignment. They may not be offset so much as to define a gap 42 which would permit the passage of the hook of another hanger. The separation between the inner edges of the front and rear walls must be less than 0.10 inches and, in the preferred embodiment, the gap is less than 0.062 inches.

The Voluntary Interindustry Commerce Standards Association (VICS) established guidelines for hangers. In the preferred embodiment of this invention, the hangers should meet the VICS standards, so that the hangers will be readily acceptable to all manufacturers and retailers. Depending on the end use of the hangers, they can be made clear or white or of any other desired color.

In most applications, a turnable metal hook will be used as the standard on the hanger, but there may be some applications where a plastic hook may be desirable. In the industry, the standard metal hook is approximately 3.75 inches high and the standard plastic hook is 3 inches high. Standard hanger sizes are 12 inch, 14 inch, 17 inch and 19 inch in the industry and the hanger of this invention may easily be utilized in such size ranges. Based on industry standards, the slope of the arms is 15 degrees plus or minus 2 degrees. This too works well with the hanger of the instant invention.

During final design of hangers made according to the instant application, the size of the openings should be configured so as to accept the standard hooks in the industry, which generally have a two inch opening.

In the industry, hangers are generally manufactured from materials that retain shatter resistance at low temperatures that are reasonably expected to be encountered in transit. Such cold impact resistance of the hanger is normally evaluated by refrigerating hangers to a temperature of 32° F. for at least two hours. Then, the cooled hanger is slid from a table from a height of 3 feet to a concrete floor. In the preferred embodiment, hangers of this invention should have the necessary cold impact resistance to withstand such a test.

Similarly, hangers in the industry are manufactured from materials that retain mechanical integrity at high temperatures that might reasonable be encountered during transit. In order to test hangers for such integrity, a one pound load is clamped normally on the hanger and the garment thickness will be between 0.1 inches and 0.2 inches. The thus loaded hanger is heated to a temperature of approximately 140° F. and maintained at that temperature for forty eight hours. If the loaded garment is not released by the hanger within the forty eight hour test period, then the hanger has satisfied the industry requirement. In the preferred embodiment of the invention, it is desirable for the hanger to retain its mechanical integrity in this manner.

In the industry, hooks stiffness and insertion into the hanger body must be adequate to prevent excessive deformation and premature failure under normal use. Strength is measured using a universal load frame by positioning the hook on a 0.5 inch diameter hardened steel pin and gripping the plastic hanger. Load will be applied at a constant rate of approximately 2 inches per minute until a load of 20 pounds is reached. The hook is considered acceptable by the industry as long as it does not fracture or deform during the test. In the preferred embodiment, it is desirable that the hanger of this invention have a hook that can withstand such a strength test. In the preferred embodiment, it is also desirable to test the ganging member in order to make certain that it is sufficiently strong to support the hook of a second hanger. To test the strength of the ganging member and the hanger, a pin the same diameter as the hook is engaged with the ganging member and a load is applied. The load is applied at a constant rate of 2 inches per minute. The ganging member is considered acceptable if a load of 25 pounds does not result in fracture of the ganging member.

According to industry standards, hangers up to 15 inches in length should be suitable for transporting and displaying garments weighing up to 1.5 pounds. For hangers up to 19 inches they should be able to transport and display garments weighting up to 2.0 pounds. In the preferred embodiment, the hangers should be able to maintain such standard industry capacities. Such capacity is confirmed by an impact test intended to simulate a garment shipping box falling off the back of a truck at a height of four feet. The impact test is performed using a test garment with evenly distributed weights, three in back, three in front, hung over the hanger. The hanger is hooked to a test device which retains the hook. This hanger is then dropped 15 inches in free fall to a rigid stop. Both the hanger and the weight fastener must remain hanging on the test fixture after the test and there must be no permanent warp of the hanger for it to be considered acceptable.

In the preferred embodiment, the hanger should be able to pass any other standard industry test, so that the hanger can be properly utilized for transporting and displaying garments throughout the industry.

In this unique manner, the hanger of this invention provides means for the hook of another hanger to pass through a first passageway from front to back (or back to front) and for a second passageway (between the front and rear walls of the ganging member) to enter from side to side.

The invention is described in detail with reference to a particular embodiment, but it should be understood that various other modifications can be effected and still be within the spirit and scope of the invention.

We claim:

1. An improved hanger for supporting hooks of other hangers in two directions comprising a body with outwardly extending arms, a top panel and a mounted hook, wherein the improvement comprises: an opening toward the lower end of said top panel defining a first passageway for supporting a hook of another hanger, wherein an axis of said first passageway is orientated in a plane perpendicular to a vertical plane of said improved hanger; and a ganging member depending downwardly from said top panel and including offset front and rear walls joined by a bottom base, whereby said front and rear walls are spaced to define a second passageway orientated in a plane perpendicular to said axis of said first passageway and for entry of a hook from another hanger which is supported by said base, and wherein inner edges of said front and rear walls are spaced sufficiently close to prevent the passage of a hook from another hanger.

2. An improved hanger according to claim 1, wherein the inner edges of said front and rear walls of said ganging member are spaced less than 0.10 inches apart.

3. An improved hanger according to claim 1, wherein the inner edges of the front and rear walls of said ganging member are spaced less than 0.062 inches apart.

4. An improved hanger according to claim 1, wherein said inner edges of said front and rear walls of said ganging member are in alignment in a horizontal plane.

5. An improved hanger according to claim 1, wherein said opening in said top panel is oval shaped.

6. An improved hanger according to claim 4, wherein said opening in said top panel is oval shaped.

7. An improved hanger according to claim 1, wherein said first passageway for supporting said hook of another hanger permits said hook of another hanger to enter said opening in said top panel from front to back; and wherein, said second passageway permits entry of said hook from another hanger from side to side.

8. An improved hanger according to claim 1, wherein said inner edges of said front and rear walls are spaced sufficiently close to prevent the passage of said hook from another hanger from front to back.

9. An improved hanger for supporting hooks of two other hangers in two directions orientated perpendicular to each other and comprising a body with outwardly extending arms, a top panel and a mounted hook, wherein the improvement comprises: an opening toward the lower end of said top panel defining a first passageway in a first plane for supporting a hook of said first other hanger; and a ganging member depending downwardly from said top panel and including offset front and rear walls joined by a bottom base, wherein said front and rear walls are spaced to define a second passageway orientated perpendicular to said plane of said first passageway and for entry of a hook from said second other hanger, and wherein inner edges of said front and rear walls are spaced close together to prevent the passage of hooks from any other hanger.

* * * * *